United States Patent [19]

Burch

[11] Patent Number: 4,854,396

[45] Date of Patent: Aug. 8, 1989

[54] PIVOTING CUTTER FOR ICE CORING AUGER

[75] Inventor: William E. Burch, Windsor, Vt.

[73] Assignee: The United States of America as represented by the Secretary of the Army, Washington, D.C.

[21] Appl. No.: 287,432

[22] Filed: Dec. 21, 1988

[51] Int. Cl.[4] ..... E21B 10/02; E21B 10/62; E21B 25/14; F25C 5/04

[52] U.S. Cl. ..... 175/18; 175/403

[58] Field of Search ..... 175/18, 402, 403, 404, 175/384, 412, 413, 323; 408/204, 206, 207, 230; 30/300

[56] References Cited

U.S. PATENT DOCUMENTS

| | | | |
|---|---|---|---|
| 2,488,003 | 11/1949 | Creighton | 175/404 X |
| 2,880,968 | 4/1959 | Titeca | 175/18 |
| 2,955,805 | 10/1960 | Jones, Jr. et al. | 175/18 |
| 3,129,775 | 4/1964 | Connelly | 175/18 |
| 3,610,768 | 10/1971 | Cochran | 175/403 X |
| 4,539,750 | 9/1985 | Jarvi et al. | 175/18 X |

FOREIGN PATENT DOCUMENTS

| | | | |
|---|---|---|---|
| 909113 | 3/1982 | U.S.S.R. | 175/404 |

*Primary Examiner*—Stephen J. Novosad

*Attorney, Agent, or Firm*—Darrell E. Hollis

[57] ABSTRACT

A method and apparatus for cutting ice core specimens from a block or sheet of ice, the invention provides swivel cutter elements mounted on the cutter head of an ice coring auger. The swivel cutters each swing into an outwardly extending position against the force of a retracting spring on contact with ice to be cut, the outward movement of the cutters being due to reaction forces acting on the cutters caused by contact with the ice. A core specimen is thereby cut to a desired depth in the ice and advancement of the coring auger is then discontinued although rotation of the auger is continued. While auger rotation continues, each swivel cutter moves inwardly under the force of the retracting spring once the reactive forces caused by advancement of the auger into the ice no longer act on the cutters. This inward movement of the swivel cutters causes a reduced necklike groove to be cut into the ice core specimen at an innermost portion of the specimen, thereby allowing the specimen to be broken away cleanly from the ice block or sheet by simple canting of the ice coring auger. The inward position of the swivel cutters further act to facilitate removal of the ice core specimen by acting to retain the specimen within the barrel of the auger.

5 Claims, 4 Drawing Sheets

PIVOTING CUTTER FOR ICE CORING AUGER

STATEMENT OF GOVERNMENT INTEREST

The invention described and claimed herein may be manufactured and used by or for the Government of the United States of America for governmental purposes without the payment of royalties thereon or therefor.

BACKGROUND OF THE INVENTION

1. Field of the Invention

The invention relates generally to method and apparatus for obtaining ice core specimens from a block or sheet of ice and relates particularly to improved ice coring auger apparatus adapted to efficiently cut an ice core specimen with a reduced- in-diameter "neck" portion which facilitates clear breakage of the specimen from the ice block or sheet.

2. Description of the Prior Art

Ice core specimens are obtained from ice sheets or ice blocks for purposes of analysis. In order for this analysis to yield valid results, it is necessary that the specimen have its structural integrity. Due to the fact that ice is a relatively weak and brittle material, ice core specimens are often damaged or effectively destroyed during the cutting process or during the process of breaking off the specimen from the remainder of the ice block or sheet after an initially successful machining with an ice coring auger.

Arduous conditions such as are imposed by artic weather or by extremely low temperatures in a laboratory facility where ice coring is normally undertaken often contribute to the difficulties involved in obtaining ice core specimens of requisite quality. While ice coring auger structures have been available for the cutting or "machining" of an ice core within a block or sheet of ice, a successfully machined finished core must be still retrieved from the body of ice from which the core has been cut. Often, successfully machined ice core specimens are destroyed or damaged during attempts to remove the specimen from the ice at its "root" since it is difficult to assure that breakage of the specimen from the ice will be confined to the root of the brittle core specimen. Prior ice coring augers have thus failed to overcome those problems previously encountered in obtaining ice core specimens of high "quality".

Examples of prior ice core cutting and coring mechanisms include U.S. Pat. Nos. 2,880,968 to Titeca and 4,539,750 to Jarvi et al. In these prior patents, cutter elements are provided which function in the primary cutting of an ice core. However, as is the situation throughout the prior art, the mechanisms of Titeca and Jarvi et al do not provide structure which facilitates the retrieval of an ice core specimen from an ice block or sheet once the core specimen has been successfully machined. Accordingly, the prior art has not provided methodology or apparatus suitable for cutting an ice core specimen from an ice block or sheet and which functions to facilitate recovery or retrieval of the core from the ice with minimal damage to the specimen.

SUMMARY OF THE INVENTION

The invention provides a method and apparatus for not only cutting or machining an ice core specimen from a block or sheet of ice but also for cutting a reduced neck-like groove in the core specimen at the "root" of the specimen to facilitate a clean break of the specimen from the ice from which the specimen is being removed. The apparatus of the invention comprehends an ice coring auger having two or more swivel cutters mounted on the cutter head of the auger. The swivel cutters act to cut a precise ice core specimen when the auger is brought into contact with an ice block or sheet. After cutting of the specimen, the swivel cutters retarct under the influence of a compression spring or similar device to cut a reduced neck-like groove into the ice core specimen at the "root" of the specimen, thereby allowing the specimen to be broken away cleanly from the ice block or sheet by a simple canting of the ice coring auger. A controlled fracture of the ice core specimen is thus facilitated while the ice core specimen is retained within the barrel of the auger. The positions which the swivel cutters assume after cutting of the reduced-in-diameter groove act to retain the ice core specimen within the barrel of the auger while the auger is lifted from the ice.

The swivel cutters of the invention swing into position and cut a precise ice core specimen when the ice coring auger is brought into contact with an ice block or sheet. Feeding of the rotating auger into the ice causes reaction forces to act on the cutting edges of the respective swivel cutters and causes the swivel cutters to pivot outwardly into positions whereby the precise ice core specimen can be cut. Stop elements act to hold the swivel cutters at positions which assure that the ice coring auger will cut an ice core of the proper size. Once the cut has been made to a desired depth in the ice, the forward feed of the ice coring auger is stopped although rotation of the auger is allowed to continue. Once the reaction forces acting on the swivel cutters is removed through discontinuation of the forward feed of the auger, compression springs or similar actuators force the swivel cutters to return to inwardly disposed positions whereby the cutting edges cut into the "root" of the ice core specimen to form a reduced-in-diameter groove or neck which thus produces a weaker portion of the core exactly at that location where it is desired for the core to be broken off. After titling or canting of the auger to fracture the ice core specimen at the reduced-in-diameter neck thus formed, the inwardly disposed position of the swivel cutters further act to retain the ice core specimen within the barrel of the auger as the auger is retracted from the ice.

Accordingly, it is an object of the present invention to provide a method and apparatus for cutting ice core specimens from a block or sheet of ice by providing pivotally mounted swivel cutter elements on the cutter head of an ice coring auger, the cutter elements acting to cut into a block or sheet of ice from which a specimen is to be removed as the auger is advanced into the ice and which will further cut a reduced- in-diameter "neck" groove into the specimen at the "root" of the specimen to facilitate clear breakage of the specimen from the ice.

It is another object of the invention to provide a method and apparatus which facilitates cutting and removal of an ice core specimen from a block or sheet of ice under the arduous conditions normally associated with the removal of ice core specimens from ice.

It is yet another object of the invention to provide method and apparatus for obtaining ice core specimens of a desired "quality" and wherein the specimens are subjected to minimal damage during initial cutting of the core from the ice and especially during the step of breaking the core specimen away from the ice.

Further objects and advantages of the invention will become more readily apparent in light of the following detailed description of the preferred embodiments.

DESCRIPTION OF THE PREFERRED EMBODIMENTS

Figure 1:
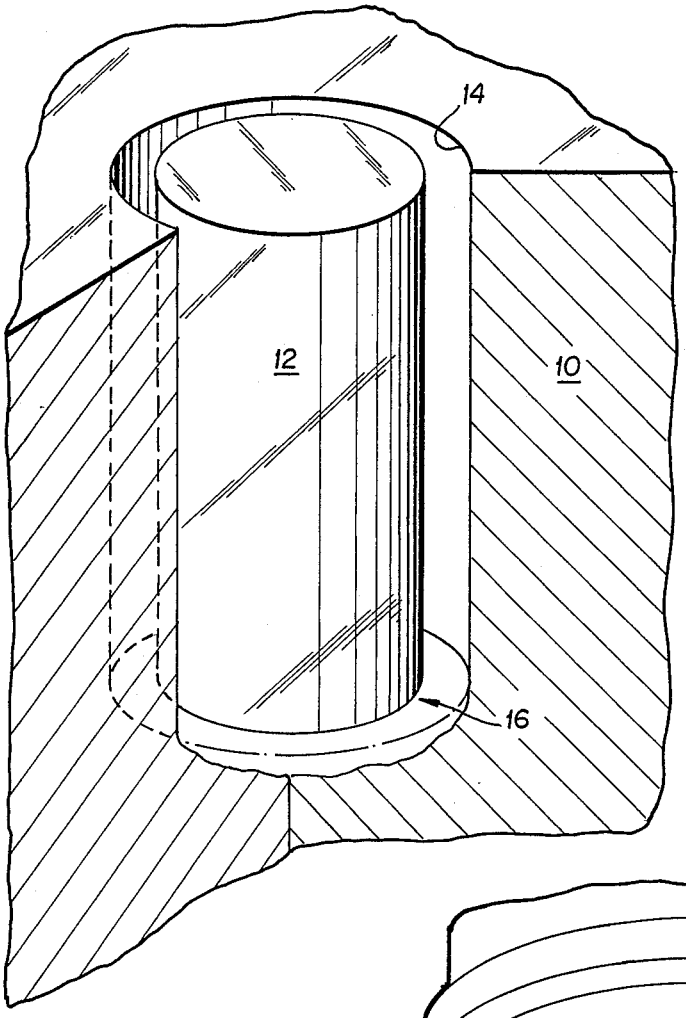
FIG. 1 PRIOR ART
FIG. 1 is a perspective view of an ice core specimen after machining of the specimen from an ice block or sheet through the use of a conventional ice coring auger.

Referring now to the drawings and particularly to FIG. 1, a mass of ice 10 which can be in either sheet or block for is seen to have been cut by a conventional ice coring auger (not shown) to form a core specimen 12 having a root portion shown at 16. The core specimen 12 after cutting is seen to be disposed within an annular cylinder 14 formed in the ice 10 by means of the auger. The ice core specimen 12 as shown in FIG. 1 is seen after removal from the ice 10 of the conventional auger in order that those problems inherent in removing the specimen 12 from the ice 10 can be appreciated. It is usually the case that the conventional ice coring auger remains in the ice 10 and an effort is made to break the ice core specimen 12 at the root 16 while the conventional auger is still in place. Techniques also exist whereby efforts are made to remove the core specimen 12 from the ice after removal of the conventional auger. In virtually all situations, it is difficult to remove the core specimen 12 and retain its structural integrity due to the fact that ice is a brittle material and it is simply difficult to break the core specimen 12 from the ice 10 at the root portion 16 and obtain a clean break at the root portion 16. Accordingly, at least some damage usually attends the removal of the core specimen 12 from the ice 10 in prior art situations as is apparent from a consideration of FIG. 1. Often, virtually complete destruction of the core specimen 12 occurs on attempts to remove said specimen 12 from the ice.

Figure 2:
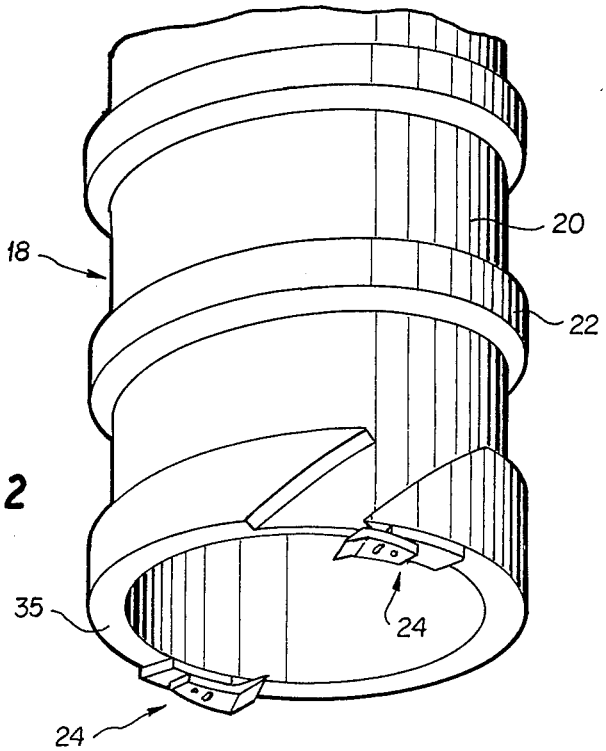
FIG. 2 is a perspective view of the cutting end of an ice coring auger fitted with swivel cutters according to the invention.
Figure 3A:
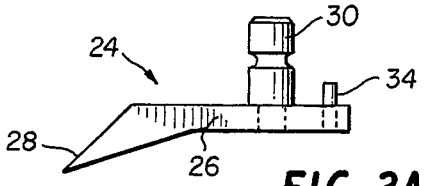
FIGS. 3A and 3B are elevational and plan views respectively of a swivel cutter of the invention.
Figure 3B:
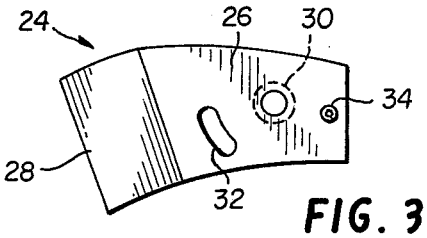

Referring now to FIGS. 2 through 6, and particularly to FIG. 2, an ice coring auger is seen at 18 to comprise an auger head 20 on which auger flights 22 are disposed. The auger 18 can be of substantially conventional form and can be powered either manually or otherwise as is conventional. Conventional ice coring augers generally include replaceable cutter elements (not shown) at the distal end of the auger head 20, the cutter elements being removable for sharpening or replacement. In conventional augers, the cutter elements are fixed in position on the head of the auger. The conventional auger thus described acts to cut the ice core specimen 12 such as seen in FIG. 1. In the present invention, however, the conventional cutter elements are replaced by two or more swivel cutters 24 which are mounted for pivotal movement on the distal end of the auger head 20 as shown in FIG. 2 and as is further shown in FIGS. 4 through 6. The swivel cutters 24 are best shown in detail in FIGS. 3A and 3B to each include a cutter body 26 and an integral cutter edge 28 which preferably takes the form of a tapered portion of the body 26. A pivot pin 30 is mounted to the body 26, the pivot pin 30 being received within a recess in the auger head 20 as will be described hereinafter. A stop pin slot 32 is also formed in the cutter body 26 on that side of the pivot pin near the cutter edge 28. The structure of the swivel cutter 24 is completed by the disposition of a fixed actuator pin 34 on the cutter body 26, the actuator pin 34 being disposed on that side of the pivot pin opposite the stop pin slot 32. As has been noted above, two or more of the swivel cutters 24 are disposed on the distal end of the auger head 20 and are preferably spaced equidistantly about the auger head 20 on a flat distally disposed perimetric portion 35 of the head 20.

Figure 6:
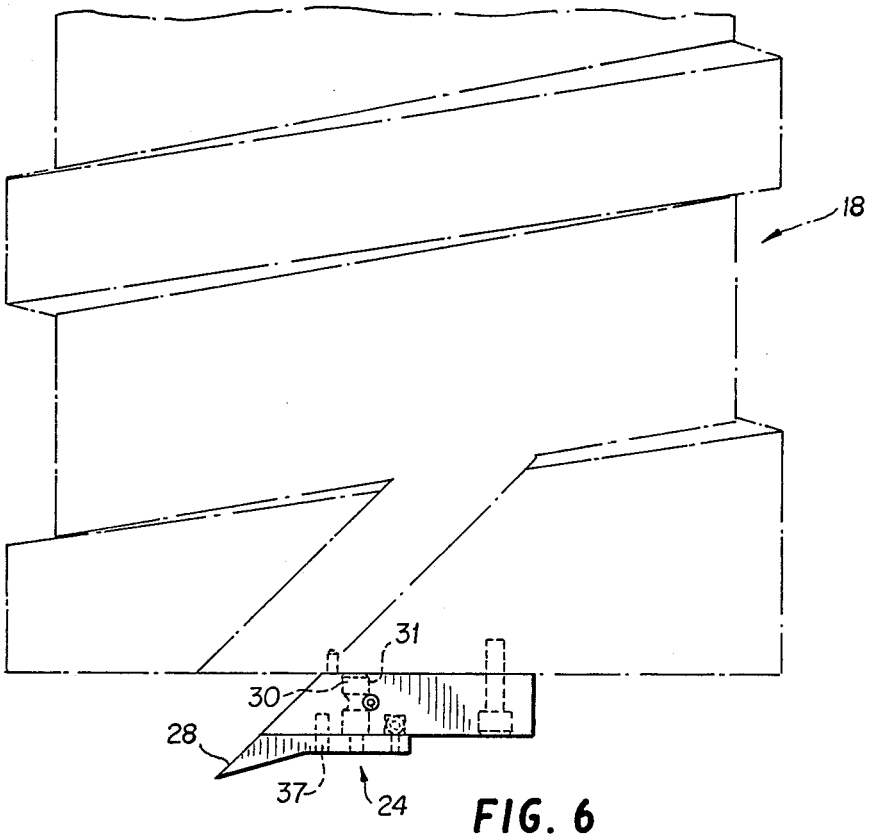
FIG. 6 a detail elevational view of one of the swivel cutters mounted to a portion of the auger head of the ice coring auger.
Figure 4:
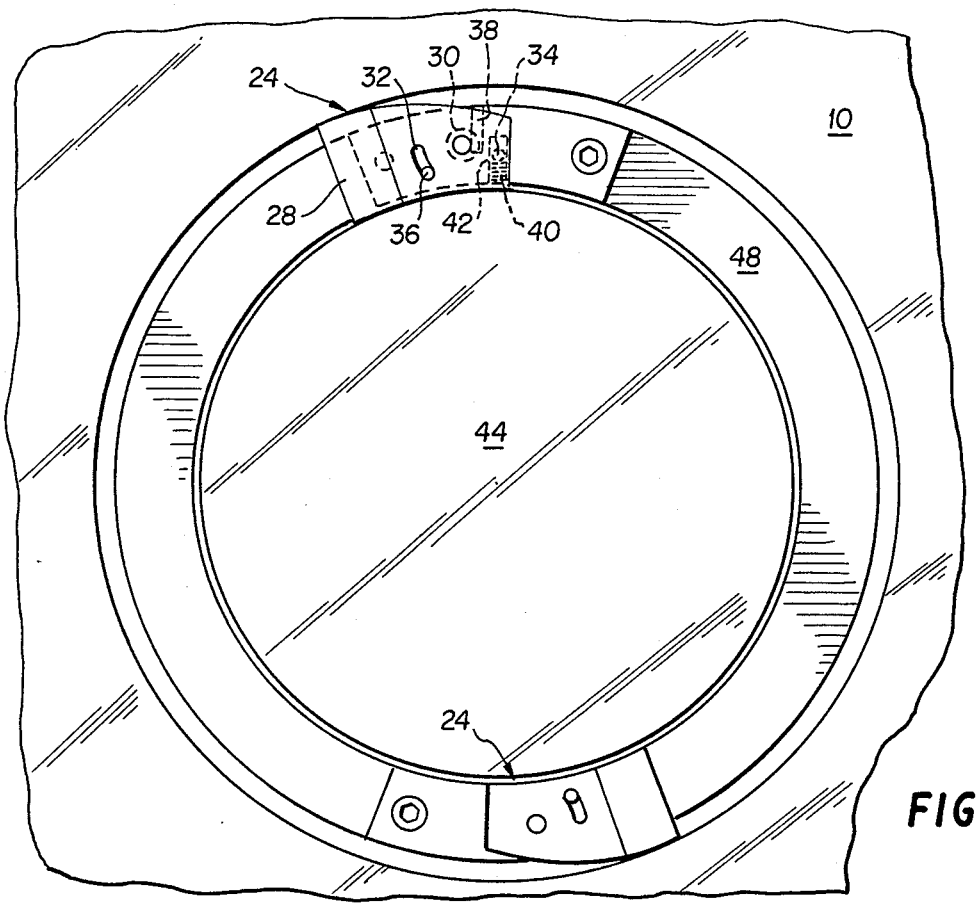
FIG. 4 is a detailed view of one of the swivel cutters operatively mounted to a portion of the auger head of the ice coring auger while the cutter is in an outwardly extended or "cutting" position.
Figure 5:
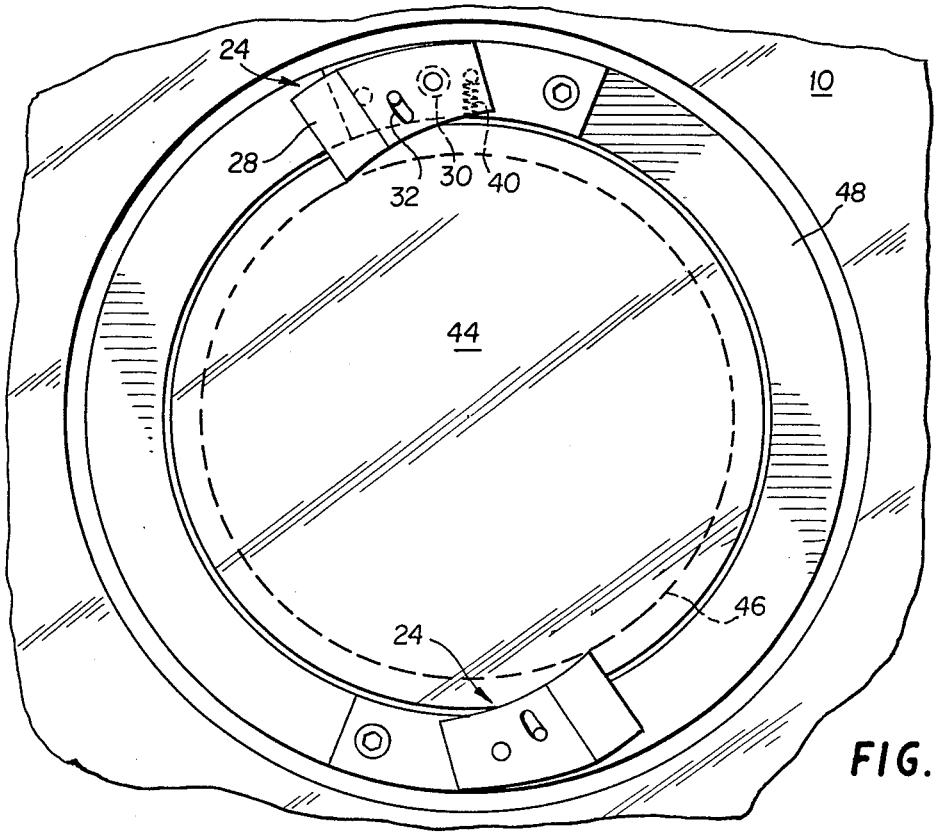
FIG. 5 is a detailed view of one of the swivel cutters operatively mounted to a portion of the auger head of the ice coring auger while the cutter is in a retracted or "necking" position.

Referring now to FIGS. 4 through 6 in particular, the pivot pin 30 on each of the swivel cutters 24 is seen to be received within a pivot pin cavity 31 formed in the auger head 20, the pivot pin being retained within the cavity 31 by means of a retainer pin 38. The swivel cutter 24 is free to pivot about the pivot pin 30, the range of motion of the swivel cutter 34 being limited by virtue of the travel of stop pin 36 within the stop pin slot 32. The stop pin 36 is fixed within a stop pin cavity 37 formed in the auger head 20. As is clearly seen in FIGS. 4 and 5, the stop pin 36 limits outward pivoting travel of the swivel cutter 24 as shown in FIG. 4 and further limits inward pivoting travel of the swivel cutter 24 as is seen in FIG. 5. The respective positions of the swivel cutter 24 in FIGS. 4 and 5 represent the "extended" or cutting configuration while the position of the swivel cutter 24 in FIG. 5 represents the "retracted" or necking position.

Figure 7:
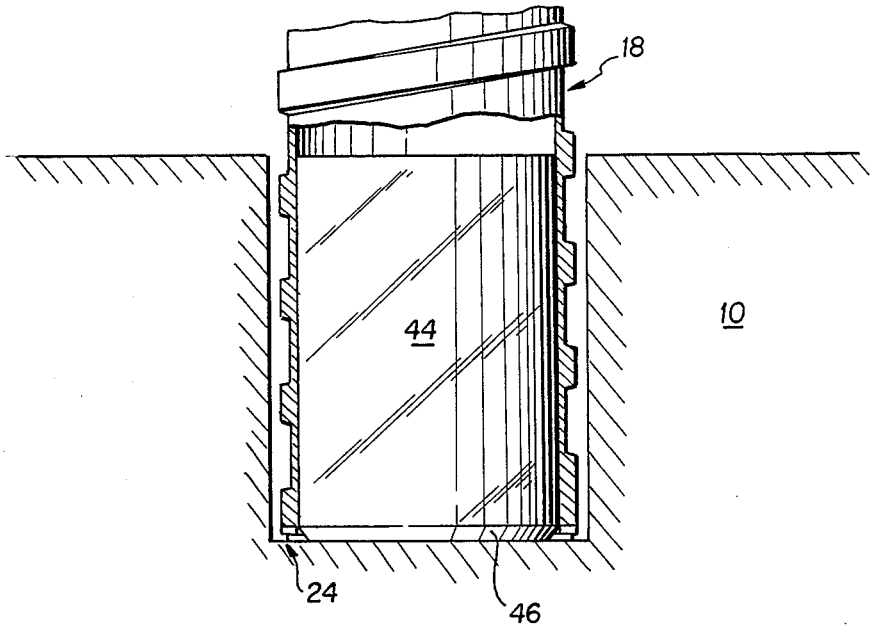
FIG. 7 is an idealized elevational view in partial section of the auger illustrating the cutting of the reduced-in-diameter neck of specimen; and, FIG. 8 is an idealized elevational view of the auger illustrating the breaking away and removal of the core specimen from the ice.

A compression spring 40 held within spring cavity 42 formed in the auger head 20 acts against the actuator pin 34 to hold the swivel cutter 24 in the position shown in FIG. 5. The position of FIG. 5 caused by the action of the compression spring 40 is that position which the swivel cutter 24 assumes either at rest or when the auger is turning but is not being advanced into a material which is to be cut. In this position, the cutter edge 28 of the swivel cutter 24 has a portion thereof disposed inwardly of the inner periphery of the auger head 20 and thereby assumes a position which cuts into an ice core specimen such as the specimen 44 shown in FIG. 7 to form a reduced neck 46 in the specimen 44 as will be described hereinafter.

The distal end of the actuator pin 34 extends upwardly from the swivel cutter 24 and into the spring cavity 42 such that the compression spring 40 acts against said actuator pin 34.

The ice coring auger 18 fitted with two or more of the swivel cutters 24 can be used to cut the ice core specimen 44 from a block or sheet of ice with the specimen 44 fitting into hollow auger barrel 48 as cutting proceeds. The swivel cutters 24 cut out an annular cylinder such as the cylinder 14 as shown in FIG. 1 as the ice coring auger 18 is advanced into the ice, this cylinder 14 being of a dimension which allows receipt of the auger head 20 into the ice. Reaction forces caused by the ice as the auger 18 is advanced into the ice causes the swivel cutters 24 to assume the extended positions as shown in FIG. 4. FIGS. 4 and 5 show only one of the swivel cutters 24 since a description of only one of the cutters is sufficient to describe the operation of each swivel cutter 24. In this "extended" or coring position, each swivel cutter 24 is caused to pivot outwardly by the reaction forces of the ice as the auger is fed into the ice, each compression spring 40 being compressed against the spring force which normally maintains the swivel cutter 24 in the position of FIG. 5. The stop pin 36 associated with each of the swivel cutters 24 causes the cutter 24 to be retained at the position shown in FIG. 4. Each swivel cutter 24 will remain in the position of FIG. 4 as long as the auger 18 is fed into the ice. The combined operation of the stop pin 36 and the stop pin slot 32 thus act to control the size of the ice core specimen by restraining the swivel cutters.

Figure 8:
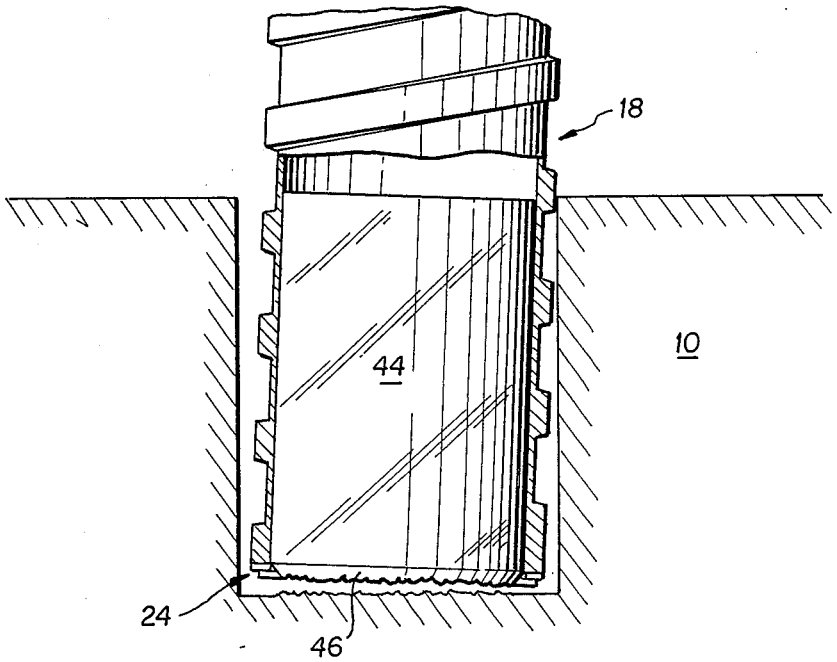

After an appropriate length of ice material has been cored by the advance of the auger 18, the advance of the auger 18 is stopped although auger rotation continues. Removal of the reaction forces caused by the ice against the swivel cutters 24 allows the compression springs 40 to pivot respective swivel cutters 24 back to the position shown in FIG. 5. Several rotations of the auger head with the swivel cutters 24 in this "retracted" position causes the reduced neck 46 or annular groove to be formed in the ice core specimen 44 of FIG. 7. The depth of the reduced neck 46 corresponds with the swept diameter of the retracted swivel cutters 24. Rotation of the auger head is then stopped and the auger 18 canted as best shown in FIG. 8 to fracture the ice core specimen 44 at the root of the specimen 44. Due to the reduced-in-diameter neck 46 which has been cut into the specimen 44, fracture readily occurs through the neck 46 since this portion of the specimen 44 is reduced in diameter and is thus the weakest portion of the specimen 44. The auger 18 is then removed from the hole thus cut in the ice, the swivel cutters 24 in the retracted positions aiding in the removal of the specimen 44 due to the fact that portions of the cutter body 26 and cutter edge 28 extend into the now fractured neck 46 of the specimen 44 and facilitate retention of the specimen 44 within the auger barrel 48. After removal of the specimen 44 from the ice, the swivel cutters 44 can be manually moved to the extended position to allow the specimen 44 to be slid out of the auger barrel 48. An ice core specimen 44 having high structural integrity and minimal damage can thus be produced.

The invention can be practiced other than as explicitly described above without departing from the intent and scope of the invention as defined by the appended claims.

What is claimed is:

1. In an ice coring auger for cutting an ice core specimen from a sheet or block of ice, the auger having an auger head defining a hollow auger barrel, the improvement comprising:

cutter means pivotally mounted to the distal end of the auger head for cutting an ice core specimen from the ice as the auger is fed into the ice, the cutter means assuming a first cutting position during feeding of the auger into the ice; and, actuator means formed on the auger for pivoting the cutter means to a second, inwardly disposed cutting position on discontinuation of feeding of the auger into the ice, the cutter means acting to cut a reduced-in-diameter neck portion in the ice core specimen while in the second cutting position, thereby facilitating breakage of the ice core specimen from the ice at the neck portion of the specimen so formed.

2. In the apparatus of claim 1 wherein the cutter means comprise at least two swivel cutters disposed regularly about the distal end of the auger head, each of the cutters comprising a body portion and a cutting edge portion, the improvement further comprising a pivot pin located on the body portion and being received and retained within a cavity formed in the auger head for mounting the swivel cutter for pivoting movement.

3. In the apparatus of claim 2 wherein the improvement further comprises a stop pin mounted on the auger head and being received within an arcuate slot formed in the body portion of the swivel cutter, the stop pin and slot acting to limit pivotal movement of the swivel cutter.

4. In the apparatus of claim 3 wherein the actuator means comprises an actuator pin mounted on the body portion of the swivel cutter, the auger head having a cavity formed therein into which the distal end of the actuator pin extends, a spring disposed in the cavity and acting against the actuator pin to cause pivoting movement of the swivel cutter to the second cutting position.

5. A method for cutting and retrieving an ice core specimen from a sheet or block of ice having an ice coring auger having cutter elements capable of pivoting movement from an outward disposed cutting position to an inwardly disposed cutting position relative to the head of the auger, the auger head defining a hollow barrel portion comprising the steps of:

feeding the auger into the ice to cut an ice core specimen, the reaction forces caused by the ice on feeding of the auger into the ice causing the cutter elements to be pivoted outwardly to a position whereby the specimen is cut into a substantially cylindrical cone which is received into the barrel portion of the auger head as cutting occurs;

discontinuing feed of the auger into the ice while continuing rotation of the auger head;

pivoting the cutter elements inwardly of the auger head and cutting a reduced-in-diameter neck portion of the ice core specimen on assumption of inwardly disposed positions of the cutter elements;

canting the auger head to break off the ice core specimen at the neck portion of the specimen; and, maintaining the ice core specimen within the barrel portion of the auger head on retrieval of the auger from the ice, the inwardly disposed locations of the cutter elements acting to hold the ice core specimen within the barrel portion of the auger.

* * * * *